US010202807B2

(12) United States Patent
Li et al.

(10) Patent No.: US 10,202,807 B2
(45) Date of Patent: Feb. 12, 2019

(54) VERTICAL SHAFT DRILLING RIG USING NOVEL DRILLING METHOD

(71) Applicant: China Railway Engineering Equipment Group Co., Ltd., Zhengzhou, Henan Province (CN)

(72) Inventors: Jianbin Li, Zhengzhou (CN); Kleuters Nikolaus, Zhengzhou (CN); Hua Zhao, Zhengzhou (CN); Ningchuan Zhang, Zhengzhou (CN); Wei Xiao, Zhengzhou (CN); Xingjian Zhuo, Zhengzhou (CN); Dujuan Wang, Zhengzhou (CN); Lianhui Jia, Zhengzhou (CN); Yanping Dong, Zhengzhou (CN); Qian Zhou, Zhengzhou (CN)

( * ) Notice: Subject to any disclaimer, the term of this patent is extended or adjusted under 35 U.S.C. 154(b) by 153 days.

(21) Appl. No.: 15/122,162

(22) PCT Filed: Dec. 9, 2014

(86) PCT No.: PCT/CN2014/093410
§ 371 (c)(1),
(2) Date: Aug. 27, 2016

(87) PCT Pub. No.: WO2015/139486
PCT Pub. Date: Sep. 24, 2015

(65) Prior Publication Data

US 2016/0369566 A1 Dec. 22, 2016

(30) Foreign Application Priority Data

Mar. 21, 2014 (CN) ..... 2014 1 0106744

(51) Int. Cl.
*E21B 15/00* (2006.01)
*E21B 3/02* (2006.01)
(Continued)

(52) U.S. Cl.
CPC ..... *E21B 4/20* (2013.01); *E21B 3/02* (2013.01); *E21B 4/006* (2013.01); *E21B 15/00* (2013.01); *E21C 1/00* (2013.01); *E21D 1/06* (2013.01)

(58) Field of Classification Search
CPC ... E21B 4/20; E21B 4/006; E21B 3/02; E21B 15/00; E21D 1/06; E21D 23/0047
See application file for complete search history.

(56) References Cited

U.S. PATENT DOCUMENTS 4,732,226 A * 3/1988 Ebeling ..... E21B 4/16 175/102
2006/0218913 A1* 10/2006 Ivantysynova ..... F15B 7/006 60/464

(Continued)

*Primary Examiner* — David J Bagnell
*Assistant Examiner* — Yanick A Akaragwe
(74) *Attorney, Agent, or Firm* — Novoclaims Patent Services LLC; Mei Lin Wong

(57) ABSTRACT

A vertical shaft drilling rig which includes a derrick and a flatcar element. The rig includes a drill pipe connecting to the derrick, a pipe joint provided on the drill pipe, a device for stabilizing cutterhead pressure connecting to the drill pipe, a torque amplification driver at which the device for stabilizing cutterhead is installed, a cutter head connected to the torque amplification driver, a separate plant on the ground surface, a muck removal system transporting the muck produced to the separate plant, an electric cabinet, a hydraulic station, a power line, and a deep shaft line extension device between the hydraulic station and the power line. The torque amplification driver includes a pressure balance valve, a planetary reducer, a drive flange and a main bearing. The deep shaft line extension device includes a float, a pulley assembly, a line reel, a steel wire and a winch.

2 Claims, 4 Drawing Sheets

(51) Int. Cl.

| | |
|---|---|
| ***E21B 4/20*** | (2006.01) |
| ***E21D 1/06*** | (2006.01) |
| ***E21B 4/00*** | (2006.01) |
| ***E21B 3/00*** | (2006.01) |

(56) References Cited

U.S. PATENT DOCUMENTS

| | | | | |
|---|---|---|---|---|
| 2010/0308265 | A1* | 12/2010 | Goldfinger | C09K 19/14<br>252/299.61 |
| 2012/0298851 | A1* | 11/2012 | Pai | E21B 47/102<br>250/269.1 |
| 2013/0248247 | A1* | 9/2013 | Sugiura | E21B 47/12<br>175/24 |

* cited by examiner

VERTICAL SHAFT DRILLING RIG USING NOVEL DRILLING METHOD

BACKGROUND OF THE PRESENT INVENTION

Field of Invention

The present invention relates drilling machinery, and more particularly to the field related to construction for mineral mining, vertical shaft for building construction, auxiliary class vertical shaft construction.

Description of Related Arts

The current drilling method utilizes large scale vertical shaft machines, which has high degree of mechanization. However, since drilling under reduced pressure is used, gravity guiding, cutterhead pressure and torque are greatly restricted. Accordingly, the drilling efficiency is low and it is difficult to achieve shaft formation rapidly.

SUMMARY OF THE PRESENT INVENTION

An object of the present invention is to solve the technical problems stated in the background of the present invention and provide a vertical shaft drilling rig with novel drilling method in which the cutterhead pressure and the torque are increased while a mandatory guiding function for the equipment is provided, thereby the accuracy of shaft formation is much higher.

In order to solve the above technical problems, the following technical solutions are provided: A vertical shaft drilling rig with novel drilling method, mainly includes a derrick installed on a pithead and a flat car for shaft cover, said rig further includes a drill pipe, a pipe joint, a device for stabilizing cutterhead pressure, a torque amplification driver, a cutter head, a muck removal system, a separate plant, an electric cabinet, a hydraulic station, a power line, and a main driver, the main driver is mounted onto the derrick and has a bottom portion connecting to the drill pipe, the pipe joint is provided on the drill pipe, the drill pipe has a bottom portion connected to the device for stabilizing cutterhead pressure, the torque amplification driver has a bottom portion connecting to the cutter head, the device for stabilizing cutterhead pressure is installed at the external side of the torque amplification driver; the muck from the forward drilling action of the cutter head in the bottom of the shaft is transported to the separate plant on the ground surface through the muck removal system. Shaft drilling construction with great torque, great drilling pressure, high verticality and high efficiency is realized.

Wherein the derrick further comprises a crane, a sliding frame, a lift cylinder; the main driver has a top portion connecting to a top rotary joint, a compressed air pipe and a slurry return pipe.

The muck removal system utilizes air lift reverse circulation.

The main driver drive the drill pipe, through the torque amplification driver to amplify the torque, the device for stabilizing cutterhead pressure applies pressure to the cutter head and provides a mandatory guiding force to the cutter head.

The device for stabilizing cutterhead pressure comprises a guiding column, a stabilizer, a forward driving hydraulic cylinder and a dynamic stabilizer; the guiding column has one end connecting to the drill pipe and another end connecting to the torque amplification driver, the stabilizer is mounted onto the guiding column and comprises at least two sets of gripping mechanism; the forward hydraulic cylinder has one end connecting to the stabilizer and another end connecting to the torque amplification driver, the dynamic stabilizer is formed by at least two set of gripping mechanism and is installed in a peripheral of the torque amplification driver, that the dynamic stabilizer will move downwardly with the cutter head during the drilling process; a direction sensor is installed on the device for cutterhead pressure to monitor the drilling direction of the equipment while a cylinder displacement sensor is installed on the stabilizer and the forward driving hydraulic cylinder to monitor the extension level of the cylinder such that a precision control of the equipment for the drilling process is achieved.

The torque amplification driver comprises a pressure balance valve, a planetary reducer, a drive flange and a main bearing. The pressure balance valve is mounted on one side of the driver so that the internal pressure of the driver and the external pressure is communicated, the planetary reducer has an input shaft connecting to the drill pipe and an output shaft connecting to the drive flange, the main bearing is mounted inside the torque amplification driver and is connected to the driver flange; the driver flange has a bottom portion connecting to the cutter head.

A deep shaft line extension device is provided between the hydraulic station and the power line. The deep shaft line extension device comprises a float, a pulley assembly, a line reel, a steel wire and a winch; the line reel and the winch are affixed on the ground surface, the pulley assembly is installed near the pithead, the power line and the steel wire are aggregated together through the pulley assembly, the line is affixed onto the steel wire, a bottom portion of the aggregated power lines and steel wire is connected to the device for stabilizing cutterhead pressure and the torque amplification driver, the float assembly is uniformly distributed along a vertical direction of the power line.

The muck removal system comprises a slurry suction pipe, a bottom rotary joint, an ordinary type drill pipe, a gas-mixing type drill pipe a drill pipe with gas pipe, a top rotary joint, a slurry output pipe, an air compressor, a compressed air pipe, a slurry pool and a slurry return pipe sequentially connected in order from the bottom to the top; compression air is used to change the density of mud inside and outside the drill pipe to achieve slurry cycling.

The present invention increases the stability of the entire machine, increases the cutterhead pressure of the equipment and increases the torque for drilling, thus the present invention is capable of being used in construction of soft soil layer as well as construction of rock strata with high strength, while its guiding precision is higher. Therefore, the construction efficiency of vertical shaft is increased, the building cycle of vertical shaft is reduced and the quality of the shaft formation is increased.

The derrick on the ground surface is formed by high strength steel through welding, its loading capacity is large, its structure is stable; the device for stabilizing cutterhead pressure provides mandatory guiding and stabilization function to the cutter head so that the equipment can operate steadily, thus the precision of shaft formation is further increased and the drilling efficiency is increased. The drilling pressure is provided by the forward driving hydraulic cylinder and weight of the structure, the stabilizer mandatory stabilizes the cutter head and the equipment can operate more steadily, thus the force status of the drill pipe and other structural parts are improved; the torque amplification driver can increase the torque of the cutter head; the deep shaft line extension device has a simple design and is capable of effective transmission of hydraulic power and control signal;

based on the sensor signal from the bottom of the shaft, the control of operation of each hydraulic cylinder in the bottom of the shaft can further achieve active steering; air lift reverse circulation can be used for construction with large amount of underground water and soft and fault formation, the wearing parts in the entire system are less and its design is simple but reliable.

BRIEF DESCRIPTION OF THE DRAWINGS

The present invention is further described in details with the following drawings, wherein.

DETAILED DESCRIPTION OF THE PREFERRED EMBODIMENT

Figure 1:
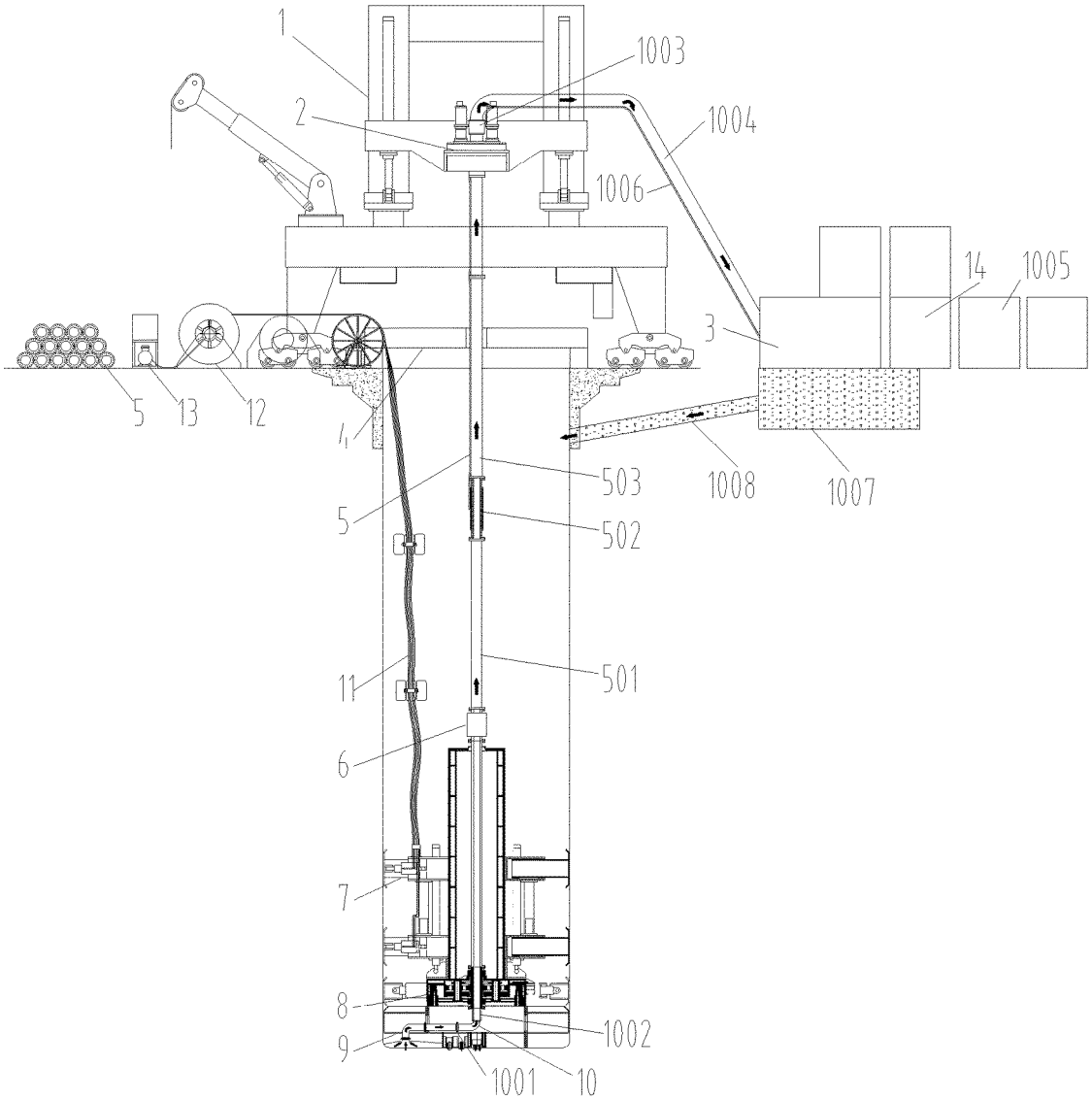
FIG. 1 is a schematic diagram of a vertical shaft drilling rig with novel drilling method according to a preferred embodiment of the present invention.

Referring to FIG. 1 of the drawings, a vertical shaft drilling rig with novel drilling method includes a derrick 1, a main driver 2, a separate plant 3, a flat car for shaft cover 4, a drill pipe 5, a pipe joint 6, a device for stabilizing cutterhead pressure 7, torque amplification driver 8, a cutter head 9, a muck removal system 10, a power line 11, a line extension device 12, a hydraulic station 13, an electric cabinet 14. The derrick 1, the flat car for shaft cover 4, the line extension device 12, the hydraulic station 13, the electric cabinet 14 and the mud processing station 3 are installed at or near to a pithead, and the main driver 2 is mounted onto the derrick 1. The derrick 1 controls the main driver 2 to slide upwardly and downwardly for realization of equipment lifting and drilling, the main driver 2 drives the drill pipe 5, the drill pipe 5 drives the cutter head through the pipe joint 6 and torque amplification driver 8 for vertical shaft drilling. The device for stabilizing cutterhead pressure 7 is used to provide forward drilling force and to control the drilling direction of the cutter head 9. The torque amplification driver 8 is used to amplify the torque transmitted from the drilling rod. The muck removal system 10 is used to transport the slag from the bottom of the shaft to the separate plant 3 on the ground surface. The electric cabinet 14 and the hydraulic station 13 are used to provide power to the equipment and to control the operation of the equipment. The power line 11 and the line extension device 12 are used for extension of pipelines and transmission of power and control signal underground. The flat car for shaft cover 4 is used with the derrick 1 to complete the safety guard of the pithead and the connection extension of the drill pipe 5. Shaft drilling construction with great torque, great drilling pressure, high verticality and high efficiency are realized.

The muck removal system 10 comprises a slurry suction pipe 1001, a bottom rotary joint 1002, an ordinary type drill pipe 501, a gas-mixing type drill pipe 502, a drill pipe with gas pipe 503, a top rotary joint 1003, a slurry output pipe 1004, an air compressor 1005, a compressed air pipe 1006, a slurry pool 1007, a slurry return pipe 1009. With the use of the air compressor 1005, the compressed air passes through the compressed air pipe 1006, the top rotary joint 1003, the drill pipe with gas pipe 503 and the gas-mixing type drill pipe 502 to transport to an internal portion of the drill pipe, the proportion of slurry inside the drill pipe is changed such that an external pressure of the drill pipe is higher than an internal pressure of the drill pipe. Through the use of the internal and external pressure, the cycling of slurry is realized. The slurry in the bottom of the shaft is transported through the slurry suction pipe 1001, the bottom rotary joint 1002, the ordinary drill pipe 501, the gas-mixing type drill pipe 502, the drill pipe with gas pipe 503, the top rotary joint 1003 and the slurry output pipe 1004 to the separate plant 3. The soil is separated from the slurry after treatment processing. After the separation processing, the slurry is transported to the slurry pool 1007 and backflow to the wellbore through the slurry return pipe 1009 for carrying out a new cycle.

Figure 2:
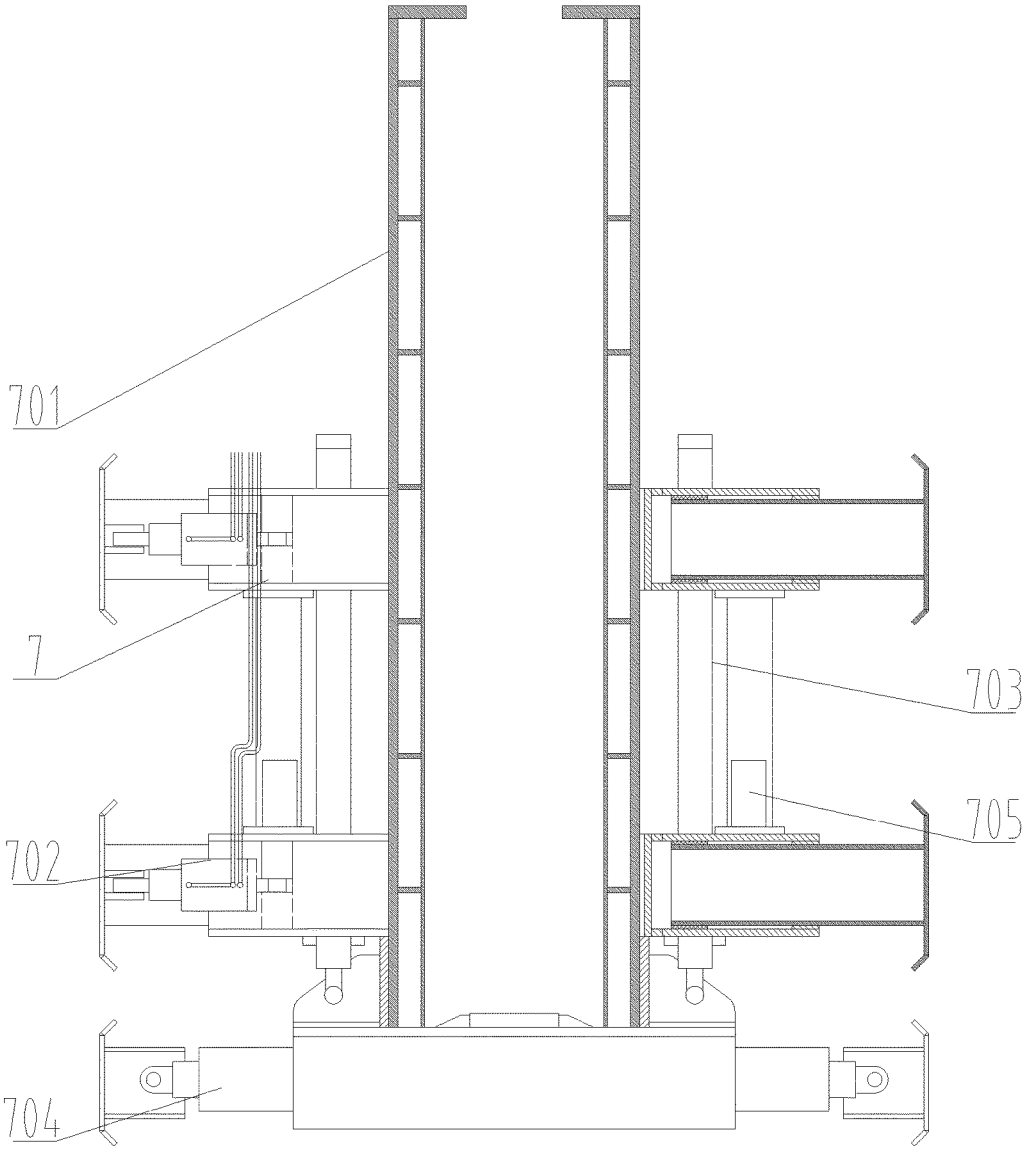
FIG. 2 is a schematic diagram of a device for stabilizing cutterhead pressure according to a preferred embodiment of the present invention.

Referring to FIG. 2 of the drawings, a vertical shaft drilling rig with novel drilling method mainly includes a derrick, a main driver, a top rotary joint, a flat car for shaft cover, a drill pipe, a pipe joint, a device for stabilizing cutterhead pressure, a torque amplification driver, a cutter head, a muck removal system, a power line, an electric cabinet, a hydraulic station, a separate plant and a pipe reel. The derrick and the flat car for shaft cover are installed on a pithead, the main driver is mounted in the derrick, the main driver has a bottom portion connecting to the drill pipe, the drill pipe is connected to the pipe joint, the drill pipe has a bottom portion at which the device for stabilizing cutterhead pressure is installed, the drill pipe has a bottom end connecting to the cutter head through the torque amplification driver.

The device for stabilizing cutterhead pressure 7 comprises a guiding column 701, a stabilizer 702, a forward driving hydraulic cylinder 703, a dynamic stabilizer 704 and a direction sensor 705. The guiding column 701 is fixedly mounted on the torque amplification driver, the stabilizer 702 has at least two sets of gripping mechanism, after the gripping mechanism is gripped tightly onto a wall of the well, the stabilizer 702 forms a stable support which controls a moving direction of the guiding column 701; the forward driving hydraulic cylinder 703 uses the stabilizer 702 as the fulcrum and moving downwardly to drive the cutter head 9 and provides a great forward moving force to the cutter head 9, the direction sensor 705 monitors the drilling direction on a real-time basis to ensure the direction of drilling, the dynamic stabilizer 704 is formed by at least two set of gripping mechanism and is installed in the peripheral of the torque amplification driver to stabilize the cutter head. When the stroke of the forward driving hydraulic cylinder 703 is finished, the derrick 1 on the ground surface and the dynamic stabilizer 704 will stabilize the equipment, then the gripping mechanism of the stabilizer 702 is returned, then the forward driving hydraulic cylinder 703 is retracted for another cycle of drilling.

Figure 3:
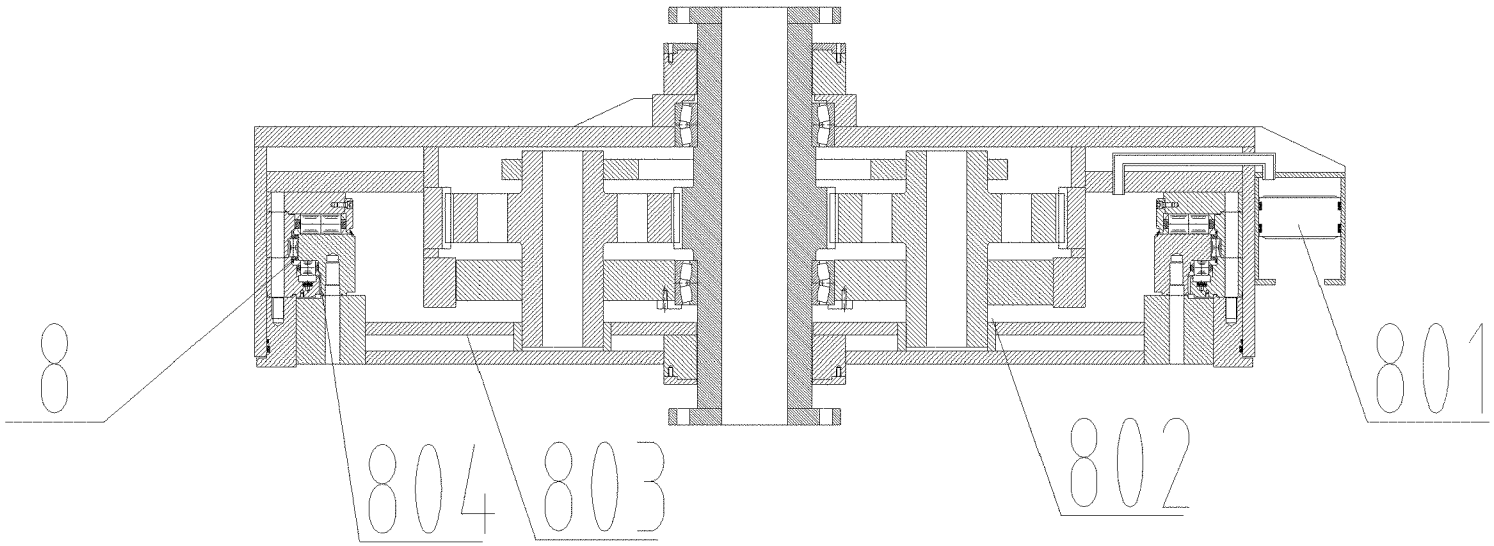
FIG. 3 is a schematic diagram of a torque amplification driver according to a preferred embodiment of the present invention.
Figure 4:
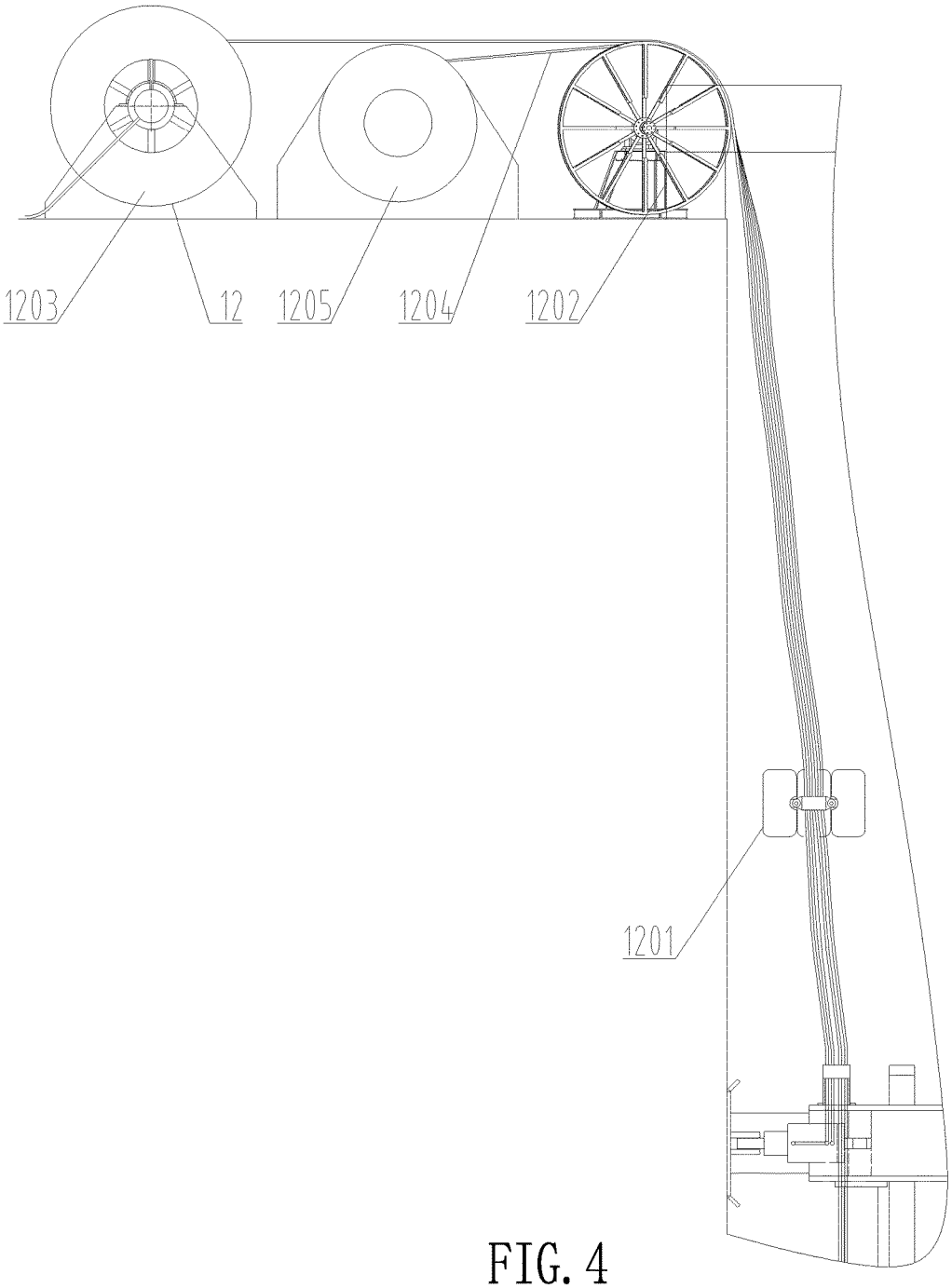
FIG. 4 is a schematic diagram of a deep shaft line extension device according to a preferred embodiment of the present invention.

Referring to FIG. 3 of the drawings, a vertical shaft drilling rig with novel drilling method is illustrated. The torque amplification driver 8 comprises a pressure balance valve 801, a planetary reducer 802, a drive flange 803 and a main bearing 804. The pressure balance valve 801 is mounted on one side of the driver so that the internal pressure of the driver and the external pressure is communicated, thus the balancing of internal and external pressure of the driver is realized. The planetary reducer 802 amplifies the torque entered from the drill pipe 5 and utilizes great torque and low speed drilling to drive the drive flange 803. The main bearing 804 is mounted inside the driver and is connected to a casing of the driver and the driver flange for withstanding the reverse thrust from the cutter head 9 and other reaction force during the drilling process.

Referring to FIG. 3 of the drawings, a vertical shaft drilling rig with novel drilling method is illustrated. The deep shaft line extension device 12 comprises a float 1201, a pulley assembly 1202, a line reel 1203, a steel wire 1204 and a winch 1205. The line reel 1203 is used to store lines. The winch 1205 is used to provide power to wind up or wind out the line. The pulley assembly 1202 is mounted near the pithead. All the power lines and steel wire are brought together through the pulley assembly 1202 while the power line is affixed onto the steel wire, then the power line and the steel wire are connected in common to the equipment in the bottom of the shaft. The float assembly is installed onto the power line along a vertical direction. The float assembly is formed by at least one float 1201. The float assembly is uniformly distributed along a vertical direction of the power line. The float 1201 can make use of its buoyancy to reduce the tension from the line itself and the tension of the line to the steel wire.

The working process of the present invention is as follows: after the installation of the vertical shaft drilling rig with novel drilling method of the present invention is complete and is ready to work, control the device for stabilizing cutterhead pressure 7 to grip tightly onto the wall of the shaft, stabilizing the cutter head 9, start the main driver 2 to drive the drill pipe 5, through the torque amplification driver 8 to drive a rotation movement of the cutter head 9; start the air compressor 1005 to feed compression air to the drill pipe, start the cycling of the slurry and the separate plant 3, control the forward driving hydraulic cylinder 703 to drive the cutter head for drilling while the main driver 2 and the drill pipe 5 are put down from the derrick on the ground surface to cooperate with the cutter head for drilling; the muck in the bottom of the shaft is carried by the slurry to move outside the shaft through air lift reverse circulation, when the stroke of the forward driving hydraulic cylinder 703 is finished, the derrick 1 on the ground surface and the dynamic stabilizer 704 will stabilize the equipment, then the gripping mechanism of the stabilizer 702 is returned, then the forward driving hydraulic cylinder 703 is retracted for another cycle of drilling. When the stroke of one section of the drill pipe is finished, the extension of the drill pipe is processed by using the derrick 1, the main driver 2, the flat car 4 and the auxiliary equipment. Then the drilling process is continued. When a preset depth of drilling is completed, the entire equipment is removed from the wellbore for proceeding construction process.

One skilled in the art will understand that the embodiments of the present invention as shown in the drawings and described above are exemplary only and should not be limited as such. The embodiments have been shown and described for the purposes of illustrating the functional and structural principles of the present invention and is subject to change without departure from such principles.

What is claimed is:

1. A vertical shaft drilling rig, which mainly comprises a derrick installed on a pithead and a flat element for covering an opening of said pithead, wherein said rig comprises a drill pipe, a pipe joint, a device for stabilizing cutterhead pressure, a torque amplification driver, a cutter head, a muck removal system, a separate plant, an electric cabinet, a hydraulic station and a power line, characterized in that, said derrick comprises a main driver, said main driver has a bottom portion connecting to said drill pipe, said pipe joint is provided on said drill pipe, said drill pipe has a bottom portion connected to said device for stabilizing cutterhead pressure, said torque amplification driver has a bottom portion connecting to said cutter head, said device for stabilizing cutterhead pressure is installed at an external side of said torque amplification driver; the muck resulting from a forward drilling action of said cutter head in the bottom of the shaft is transported to said separate plant on the ground surface through said muck removal system, said torque amplification driver comprises a pressure balance valve, a planetary reducer, a drive flange and a main bearing; wherein said pressure balance valve is mounted on one side of said torque amplification driver so that an internal pressure and an external pressure of said torque amplification driver are communicated; said planetary reducer has an input shaft connecting to said drill pipe and an output shaft connecting to said drive flange, said main bearing is mounted inside said torque amplification driver and is connected to said driver flange; said driver flange has a bottom portion connecting to said cutter head.

2. A vertical shaft drilling rig, which mainly comprises a derrick installed on a pithead and a flat element for covering an opening of said pithead, wherein said rig comprises a drill pipe, a pipe joint, a device for stabilizing cutterhead pressure, a torque amplification driver, a cutter head, a muck removal system, a separate plant, an electric cabinet, a hydraulic station and a power line, characterized in that, said derrick comprises a main driver, said main driver has a bottom portion connecting to said drill pipe, said pipe joint is provided on said drill pipe, said drill pipe has a bottom portion connected to said device for stabilizing cutterhead pressure, said torque amplification driver has a bottom portion connecting to said cutter head, said device for stabilizing cutterhead pressure is installed at an external side of said torque amplification driver; the muck resulting from a forward drilling action of said cutter head in the bottom of the shaft is transported to said separate plant on the ground surface through said muck removal system, a deep shaft line extension device is provided between said hydraulic station and said power line, said deep shaft line extension device comprises a float, a pulley assembly, a line reel, a steel wire and a winch; wherein said line reel and said winch are affixed on the ground surface, said pulley assembly is installed in the pithead, said power line and said steel wire are aggregated together through said pulley assembly, said power line is affixed onto said steel wire, a bottom portion of said aggregated power line and steel wire is connected to said device for stabilizing cutterhead pressure and said torque amplification driver, said float assembly is uniformly distributed along a vertical direction of said power line.

* * * * *